United States Patent [19]

Jacobs et al.

[11] Patent Number: 5,064,554

[45] Date of Patent: Nov. 12, 1991

[54] PROCESS FOR THE PRODUCTION OF DETERGENTS IN THE FORM OF FUSED BLOCKS CONTAINING ALKALI HYDROXIDES AND, OPTIONALLY, ACTIVE CHLORINE FOR USE IN DISHWASHING MACHINES

[75] Inventors: Jochen Jacobs, Wuppertal; Theodor Altenschoepfer, Duesseldorf; Peter Jeschke, Neuss, all of Fed. Rep. of Germany

[73] Assignee: Henkel Kommanditgesellschaft auf Aktien, Duesseldorf-Holthausen, Fed. Rep. of Germany

[21] Appl. No.: 107,235

[22] Filed: Oct. 9, 1987

[30] Foreign Application Priority Data

Oct. 13, 1986 [DE] Fed. Rep. of Germany ..... 3634812

[51] Int. Cl.[5] ..... C11D 7/18

[52] U.S. Cl. ..... 252/99; 252/102

[58] Field of Search ..... 252/99, 102

[56] References Cited

U.S. PATENT DOCUMENTS 2,412,819 12/1946 MacMahon ..... 252/138
4,569,780 2/1986 Fernholz et al. ..... 252/90
4,569,781 2/1986 Fernholz et al. ..... 252/92
4,690,770 9/1987 Jesche et al. ..... 252/99
4,729,845 3/1988 Altenschoepfer ..... 252/99

FOREIGN PATENT DOCUMENTS 3519353 5/1985 Fed. Rep. of Germany .
3519355 5/1985 Fed. Rep. of Germany .

*Primary Examiner*—Josephine Barr
*Attorney, Agent, or Firm*—Ernest G. Szoke; Wayne C. Jaeschke; Real J. Grandmaison

[57] ABSTRACT

A process for the preparation of a homogeneous, storage-stable detergent for dishwashing machines in the form of fused blocks containing alkali metal hydroxide, alkali metal silicate, water, penta-alkali metal triphosphate, active chlorine donor, and organic complexing agent; comprising preparing a melt of alkali metal silicate, alkali metal hydroxide and water, maintaining the melt at a temperature of about 50° C. to about 75° C., adding to the melt an active chlorine donor and an organic complexing agent, introducing the melt into a flow mixer together with a penta-alkali metal triphosphate and distributing the triphosphate in the melt, pouring the resulting liquid mixture into flexible molds, and allowing the mixture to solidify.

12 Claims, No Drawings

PROCESS FOR THE PRODUCTION OF DETERGENTS IN THE FORM OF FUSED BLOCKS CONTAINING ALKALI HYDROXIDES AND, OPTIONALLY, ACTIVE CHLORINE FOR USE IN DISHWASHING MACHINES

BACKGROUND OF THE INVENTION

1. Field of the Invention

Solid detergents for dishwashing machines are sold predominantly in powder or granulate form. The individual particles of these detergents have a preferred diameter of from about 0.01 to about 3 mm. A serious disadvantage of solid detergents of this type, particularly those used institutionally with an alkali hydroxide content of from 10 to 60% by weight, is that, on account of the hygroscopicity of the individual raw materials, they show a pronounced tendency towards caking or clumping in the presence of small quantities of moisture.

By adding so-called "anti-caking" agents, such as paraffin for example, or by coating the highly hygroscopic constituents, such as for example the alkali metal hydroxides and the sodium metasilicate, with powder-form substances, such as for example pentasodium triphosphate or sodium sulfate, it is possible to obtain slight improvements in the caking or clumping behavior, although relatively large quantities of moisture in the form of water or water vapor still lead to caking or clumping of the powder-form or granulated detergents.

Although this does not make the detergents unuseable, because the effect of the individual constituents remains intact, even after clumping or caking in the presence of moisture, the appearance of the detergents in most cases is diminished or inferior in the eyes of the consumer, resulting in complaints.

The use of detergents which cake or clump in the presence of moisture is a particular disadvantage in automatic, dispenser-type metering units which are used in large numbers in institutional single-tank and multi-tank dishwashing machines. Metering problems arise either because too little detergent is dispensed or because the dispenser system itself is mechanically damaged and becomes unuseable. The only remedy is to prevent moisture from entering the storage compartment, although this cannot be guaranteed in the moist atmosphere of kitchens or after the machine has been cleaned with water without special drying of the storage compartment and the dispenser.

The clumping or caking of alkaline detergents can be avoided, inter alia, by preparing them in block form from the outset and packaging, marketing and using them in highly moisture-proof form.

2. Discussion of Related Art

U.S. Pat. No. 2,412,819 describes briquetted detergents for dishwashing machines which are produced by mixing together all the alkaline-reacting active substances preferably containing water of hydration, such as for example sodium silicates, pentasodium triphosphate, sodium hydroxide and, optionally, water if the preferred water of hydration in the compounds mentioned is not sufficient, and then gently heating the mixture with stirring to 90° to 100° C. until a uniformly molten mass is formed, pouring this melt into molds and allowing it to solidify into a compact crystal aggregate therein.

However, this does not in any way solve every problem because compounds containing active chlorine are extremely difficult to incorporate in strongly alkaline detergents.

Thus, European Patent 3 769 describes detergent containers, more especially for dishwashing machines, which contain solid detergent blocks produced from water and two solid constituents, at least one of which is an alkaline hydratable compound, and which are only open at one point from which the detergent is subsequently flushed out into the dishwashing machine by a stream of water. If, in addition to alkali metal hydroxides, these detergents are intended to contain active chlorine compounds which are regarded as necessary for the removal of bleachable soil, such as for example tea, coffee, fruit juices etc., they have to be introduced, preferably as preformed cores, into the soft mass during solidification of the detergent. In order to more effectively protect the chlorine donor, the core is said to be coated either with paraffin or with a wax-like mono- or dialkyl ester of polyphosphonic acid. The direct incorporation of compounds containing active chlorine, particularly in the presence of high concentrations of alkali metal hydroxide, is regarded as impracticable. In Example b 13, Table 1 of said patent it is shown that the direct addition of an active chlorine donor to the melt leads to a high loss of active chlorine in only 24 hours. The chlorine donors tested were $Ca(OCl)_2$, LiOCl and Na dichloroisocyanurate dihydrate. Residual chlorine activities of from only 3.5 to 17.4% of the original value were determined, depending on the chlorine donor.

Although the incorporation of preformed cores containing active chlorine donors is possible, such involves high costs through labor-intensive production and the necessary raw materials. In addition, the detergent blocks and their cores naturally differ in solubility.

Earlier German patent applications P 35 19 353.0 and P 35 19 355.7 describe a process wherein it is possible to work at low and, therefore, safe temperatures of from 45° to 70° C., and preferably from 45° to 65° C., providing the anhydrous alkali metal silicate as metasilicate hydrate and/or as waterglass solution, is first heated either by itself or together with solid alkali metal hydroxide or its monohydrate to 45° to 48° C. without influencing the resulting spontaneous heating to 60° to 65° C., all the other constituents, preferably containing water of hydration, including lastly, after the temperature of the melt has fallen to about 50° to 55° C., pentasodium triphosphate and/or its hexahydrate, organic complexing agents or an active chlorine donor are then introduced with stirring or kneading and the still liquid melt is poured into preferably flexible molds of any shape and allowed to solidify into blocks therein.

Therefore, an object of the present invention is to provide a process by which even active chlorine donors may optionally be incorporated in uniform distribution in block-form detergents in the presence of alkali metal hydroxides. At the same time, the invention seeks to provide detergent formulations which correspond to the present generation of standard powder-form or granular products for institutional dishwashing machines without the penta-alkali metal triphosphate jointly used being hydrolyzed and completely or partly degraded to the orthophosphate.

DESCRIPTION OF THE INVENTION

Other than in the operating examples, or where otherwise indicated, all numbers expressing quantities of ingredients or reaction conditions used herein are to be understood as modified in all instances by the term "about".

Accordingly, the present invention relates to a process for the preparation of a homogeneous, storage-stable detergent for dishwashing machines in the form of fused blocks containing alkali metal hydroxide; alkali metal silicate and water, preferably as water of crystallization, penta-alkali metal triphosphate and, optionally, an active chlorine donor and/or organic complexing agent, wherein a melt comprising alkali metal silicate, alkali metal hydroxide and, optionally, water is initially prepared and is maintained by cooling or heating at a temperature of about 50° to about 75° C., and preferably at about 55° to about 70° C., adding to the melt an active chlorine donor and/or organic complexing agent optionally with careful control, at a temperature of from 70° to 75° C., introducing the resulting melt into a flow mixer together with the penta-alkali metal triphosphate and, optionally, other typical components of dishwashing detergents, the additional solid, powder-form or granular raw materials being distributed in the melt, and immediately afterwards pouring the still liquid mixture into preferably flexible molds of any shape, and allowing the mixture to solidify therein.

The flow mixer used may be of the type which is also suitable for the production of suspensions or pastes. Preferred flow mixers include those which effect uniform distribution of the pentasodium triphosphate in the melt for a short residence time of less than about 1 minute and provide a narrow residence time spectrum, such as for example, an injection mixer of the type made by FMC.

In the practice of the process, the inlets and outlets of the mixer are heated so that their internal temperatures are from about 50° to about 75° C. and correspond to those of the melt. Higher temperatures may result, on the one hand, in partial degradation of the active chlorine donor and, on the other hand, in phosphate degradation in the melt after it has been poured into the molds. Lower temperatures may result in at least partial crystallization of the melt in the preparation vessel, in the metering unit, in the pipes or in the mixer, and may thus result in technical difficulties.

The alkali metal hydroxide used may be potassium hydroxide and, for reasons of cost, is preferably sodium hydroxide, it is preferably used in solid form, i.e. as flakes or prills, and in substantially anhydrous form or as the monohydrate. However, approximately 50% aqueous alkali metal hydroxide solutions may also be used. In that case, the water content has to be taken into consideration for the composition as a whole. The quantity used amounts to between about 2 and about 70% by weight, and preferably between about 5 and about 50% by weight (anhydrous), based on the detergent as a whole.

The alkali metal silicate used is preferably alkali metal metasilicate in anhydrous form, but may advantageously be in the form of sodium metasilicate . 9 $H_2O$, sodium metasilicate . 6 $H_2O$ and sodium metasilicate . 5 $H_2O$. For the particular form, the quantity used amounts to between 0 and about 60% by weight, and preferably to between 0 and about 50% by weight, based on the detergent as a whole. However, the alkali metasilicate may even be partly or completely replaced by a waterglass solution in which the ratio of $Na_2O$ to $SiO_2$ is from 1:1 to 1:4, and preferably from 1:2 to 1:3.5. On account of the higher silicate content of waterglass, the waterglass solution is used in a quantity of from 0 to about 30% by weight, and preferably of from 0 to about 15% by weight, based on the detergent as a whole.

Suitable organic complexing agents, which may be solubility-promoting constituents of the fused-block detergent, include polycarboxylic acids, hydroxycarboxylic acids, aminocarboxylic acids, carboxyalkyl ethers, polyanionic polymers, more especially polymeric carboxylic acids and phosphonic acids, these compounds being used in the form of their water-soluble salts.

The content of organic complexing agent is from 0 to about 10% by weight, and preferably from 0 to about 5% by weight, based on the detergent as a whole.

The active chlorine donor used may be any of the various chlorinated compounds of isocyanuric acid, such as sodium or potassium dichloroisocyanurate, sodium dichloroisocyanurate dihydrate (Na-DCC-$2H_2O$), sodium monochloroamidosulfonate or N-chlorosulfamate, and sodium N-chloro-p-toluene sulfonic acid amide ("chloramine T"). One feature common to all these active chlorine donors is that they have a hydrolysis constant of up to about $3\times10^{-4}$ (cf. W. G. Mizuno "Dishwashing", Chapter 21, more especially page 875, Table 7 in "Detergency, Theory and Test Methods", Part 3 (1981), Marcel Dekker, N.Y.).

The active chlorine donor is used in a quantity of up to about 4% by weight, and preferably in a quantity of up to about 2% by weight, based on its active chlorine content, which may be determined for example by iodometric titration, and on the detergent as a whole.

It is possible by the process according to the invention, to provide a highly alkaline composition to obtain readily pourable and homogeneously solidifying fused blocks by using a commercial, substantially anhydrous sodium triphosphate having a low phase-I content. An increase in the phosphate retention level to more than 85% may be obtained by using a granulated phosphate having a low residual moisture content (below 2%) and a high individual grain density. In such case, however, sedimentation of the phosphate granulates may occur after the melt suspension has been poured into the mold because the increase in viscosity of the melt is decelerated by partial degradation of the triphosphate. The blocks are then no longer homogeneous in their composition so that the detergent cannot be properly dispensed according to the particular formulation inside the dishwashing machine due to gradual flushing away of the blocks.

In one preferred embodiment, therefore, a mixture of commercial, coarse, granulated low-water to anhydrous phosphate particles and commercial, finely-divided phosphate particles are simultaneously incorporated in the melt in order to obtain, on the one hand, high phosphate retention levels and, on the other hand, a homogeneous composition of the fused blocks.

The ratio by weight of the afore-mentioned two phosphate types to one another may vary within wide limits. With highly alkaline formulations, a ratio of coarse-grained to fine-grained phosphate of from about 10:1 to 2:1, and preferably of from 6:1 to 3:1, respectively, has proved effective. With formulations having a low alkaline material content, phosphate retention levels of more than about 90% are obtained even when using fine-grained phosphate alone. In all, from about 2 to about 50% by weight, and preferably from about 5 to about 45% by weight, of penta-alkali metal phosphate is used.

The total water content of the fused-block detergents having compact crystal units is from about 10 to about 40% by weight, and preferably from about 15 to about 30% by weight. It is preferably introduced by the water of crystallization content of the alkaline-reacting active substances, although it may even be introduced through a waterglass solution Accordingly, the water content calculations must be based on these compounds.

The solidification process of the melts obtained by the process according to the invention lasts from a few minutes to about 1 hour, depending on the size of the mold and the composition of the melt. The final fused blocks may be very hard, hard or not very hard, depending on their composition, but in any case show a uniform composition throughout and dissolve rapidly in use.

EXAMPLE I

A mixture comprising 10 parts by weight waterglass N ($Na_2O:SiO_2=1:3.35$; 34.5% solids), 8 parts by weight NaOH (50%), 35 parts by weight NaOH prills, and 11 parts by weight MCAS solution (Na salt of monochloroamdosulfonic acid blended in NaOH) was prepared in a stirring vessel, the active chlorine donor being added at a temperature below 70° C., and regulated to 67° C. The melt was fed at that temperature into a heated FMC mixer (rotational speed of the mixing spiral 800 r.p.m., rotational speed of the powder spiral 800 r.p.m.). For a total throughput of about 500 kg/h, 64% by weight of the melt was continuously mixed with 9% by weight of finely-divided pentasodium triphosphate (Triphosphat N® of Hoechst-Knapsack) and with 27% by weight of coarse-grained pentasodium triphosphate (Makrophos GH® of Benckiser-Knapsack). The resulting melt suspension was poured into flexible molds to provide 1 kg portions. After solidification and cooling, phosphate retention levels of more than 70% were observed.

EXAMPLE 11

A melt comprising a mixture of 32 parts by weight sodium metasilicate, nonahydrate, 4 parts by weight NaOH prills, 11 parts by weight MCAS solution (as in Example 1), and 22 parts by weight sodium metasilicate, anhydrous, was prepared in a stirring vessel with a rise in temperature to 62° C. The anhydrous metasilicate dissolved only partly in this formulation during the stirring time of approximately 30 minutes. The undissolved component was suspended therein. The melt was fed at 62° C. into the FMC mixer, mixed therein with 31 parts by weight finely-divided pentasodium triphosphate and poured into molds to provide 1 kg portions. After cooling and solidification, a phosphate retention level of approximately 90% was found.

We claim:

1. A process for the continuous preparation of a homogeneous, storage-stable detergent for dishwashing machines in the form of fused blocks containing alkali metal hydroxide, alkali metal silicate, water, penta-alkali metal triphosphate, active chlorine donor, and organic complexing agent; comprising a) separately preparing a melt of less than about 50% by weight of alkali metal silicate, from about 5 to about 50% by weight of alkali metal hydroxide and from about 15 to about 30% by weight of water at a temperature of about 50° C. to about 75° C., adding to said melt less than about 2% by weight of an active chlorine donor and less than about 5% by weight of an organic complexing agent at a temperature of about 70° C. to about 75° C., b) introducing said melt continuously into a flow mixer together with from about b 5 to about 45% by weight of a separately fed penta-alkali metal triphosphate thereby distributing said triphosphate in said melt for less than about one minute, c) pouring the resulting liquid mixture into flexible molds, and d) allowing the mixture to solidify in said molds.

2. A process as in claim 1 including immediately pouring said mixture into said molds.

3. A process as in claim 1 wherein said alkali metal hydroxide is selected from potassium hydroxide and sodium hydroxide.

4. A process as in claim 1 wherein said alkali metal silicate is selected from sodium metasilicate nonahydrate, sodium metasilicate hexahydrate, and sodium metasilicate pentahydrate.

5. A process as in claim 1 wherein said alkali metal silicate is a waterglass solution in which the ratio of $Na_2O$ to $SiO_2$ is from about 1:1 to about 1:4.

6. A process as in claim 5 wherein said waterglass solution is present in a quantity of from 0 to about 30% by weight, based on the weight of said detergent.

7. A process as in claim 1 wherein said organic complexing agent is selected from a polycarboxylic acid, hydroxycarboxylic acid, aminocarboxylic acid, carboxyalkyl ether, polyanionic polymer, and phosphonic acid, and a salt thereof.

8. A process as in claim 1 wherein said active chlorine donor is selected from a chlorinated compound of isocyanic acid having a hydrolysis constant of up to about $3\times10^{-4}$.

9. A process as in claim 1 wherein said triphosphate comprises a substantially anhydrous sodium triphosphate having a low phase-I content.

10. A process as in claim 1 wherein said triphosphate comprises a mixture of coarse phosphate particles and finely-divided phosphate particles in a weight ratio of from about 10:1 to 2:1, respectively.

11. A continuous process for the preparation of a homogeneous, storage-stable detergent for dishwashing machines in the form of fused blocks containing alkali metal hydroxide, alkali metal silicate, water, penta-alkali metal triphosphate, active chlorine donor, and organic complexing agent; comprising a) separately preparing a melt of less than about 60% by weight of alkali metal silicate, from about 2 to about 70% by weight of alkali metal hydroxide and from about 10 to about 40% by weight of water at a temperature of about 50° C. to about 75° C., adding to said melt at a temperature of about 70° C. to about 75° C. less than about 4% by weight of an active chlorine donor and less than about 10% by weight of an organic complexing agent, b) introducing said melt continuously into a flow mixer together with from about 2 to about 50% by weight of a separately fed penta-alkali metal triphosphate thereby distributing said triphosphate in said melt for less than about one minute, c) pouring the resulting liquid mixture into flexible molds, and d) allowing the mixture to solidify in said molds, all weights being based on the weight of said detergent.

12. A process as in claim 11 wherein said triphosphate comprises a mixture of coarse phosphate particles and finely-divided phosphate particles in a weight ratio of from about 10:1 to 2:1, respectively.

* * * * *